US008520857B2

(12) United States Patent
Fukui et al.

(10) Patent No.: US 8,520,857 B2
(45) Date of Patent: Aug. 27, 2013

(54) HEAD-RELATED TRANSFER FUNCTION MEASUREMENT METHOD, HEAD-RELATED TRANSFER FUNCTION CONVOLUTION METHOD, AND HEAD-RELATED TRANSFER FUNCTION CONVOLUTION DEVICE

(75) Inventors: Takao Fukui, Tokyo (JP); Ayataka Nishio, Kanagawa (JP)

(73) Assignee: Sony Corporation, Tokyo (JP)

( * ) Notice: Subject to any disclaimer, the term of this patent is extended or adjusted under 35 U.S.C. 154(b) by 620 days.

(21) Appl. No.: 12/366,056

(22) Filed: Feb. 5, 2009

(65) Prior Publication Data

US 2009/0208022 A1 Aug. 20, 2009

(30) Foreign Application Priority Data

Feb. 15, 2008 (JP) ..... 2008-034236

(51) Int. Cl.
*H04R 5/00* (2006.01)

(52) U.S. Cl.
USPC ..... 381/17; 381/18; 381/303; 704/500

(58) Field of Classification Search
USPC ..... 318/17, 18, 23
See application file for complete search history.

(56) References Cited

U.S. PATENT DOCUMENTS

| | | | | |
|---|---|---|---|---|
| 5,181,248 | A | 1/1993 | Inanaga et al. | |
| 5,717,767 | A | 2/1998 | Inanaga et al. | |
| 6,501,843 | B2 * | 12/2002 | Usui et al. | 381/302 |
| 2005/0047619 | A1 * | 3/2005 | Murata et al. | 381/309 |
| 2009/0214045 | A1 | 8/2009 | Fukui et al. | |

FOREIGN PATENT DOCUMENTS

| | | | |
|---|---|---|---|
| JP | 61-245698 | A | 10/1986 |
| JP | 03-214897 | | 9/1991 |
| JP | 5-260590 | A | 10/1993 |
| JP | 6-147968 | A | 5/1994 |
| JP | 06-165299 | A | 6/1994 |
| JP | 06-181600 | A | 6/1994 |
| JP | 07-312800 | A | 11/1995 |
| JP | 8-047078 | A | 2/1996 |

(Continued)

OTHER PUBLICATIONS

Kendall et al. "A Spatial Sound Processor for Loudspeaker and Headphone Reproduction" Journal of the Audio Engineering Society, May 30, 1990, vol. 8 No. 27, pp. 209-221, New York, NY.

*Primary Examiner* — Lynne Gurley
*Assistant Examiner* — Vernon P Webb
(74) *Attorney, Agent, or Firm* — Wolf, Greenfield & Sacks, P.C.

(57) ABSTRACT

A head-related transfer function measurement method includes the steps of: first measuring, including placing an acousto-electric conversion unit nearby both ears of a listener where placement of an electro-acoustic conversion unit is assumed, picking up sound waves emitted at a perceived sound source position with the acousto-electric conversion unit in a state with a dummy head or a human at the listener position, and measuring a head-related transfer function from only the sound waves directly reaching the acousto-electric conversion unit; second measuring, including picking up sound waves emitted at a perceived sound source position with the acousto-electric conversion unit, with no dummy head or human at the listener position, and measuring a natural-state transfer property from only the sound waves directly reaching the acousto-electric conversion unit; normalizing the head-related transfer function with the natural-state transfer property to obtain a normalized head-related transfer function; which is stored in a storage unit.

12 Claims, 10 Drawing Sheets

(56) References Cited

FOREIGN PATENT DOCUMENTS

| | | | |
|---|---|---|---|
| JP | 8-182100 | A | 7/1996 |
| JP | 09-037397 | A | 2/1997 |
| JP | 09-135499 | A | 5/1997 |
| JP | 09-187100 | A | 7/1997 |
| JP | 09-284899 | A | 10/1997 |
| JP | 10-042399 | A | 2/1998 |
| JP | 2000-036998 | A | 2/2000 |
| JP | 2001-285998 | A | 10/2001 |
| JP | 2002-209300 | A | 7/2002 |
| JP | 2003-061196 | A | 2/2003 |
| JP | 2003-061200 | A | 2/2003 |
| JP | 2004-080668 | A | 3/2004 |
| JP | 2005-157278 | A | 6/2005 |
| JP | 2007-240605 | A | 9/2007 |
| JP | 2007-329631 | A | 12/2007 |
| WO | WO 95/13690 | | 5/1995 |
| WO | WO 95/23493 | A1 | 8/1995 |
| WO | WO 01/31973 | A1 | 5/2001 |

* cited by examiner

HEAD-RELATED TRANSFER FUNCTION MEASUREMENT METHOD, HEAD-RELATED TRANSFER FUNCTION CONVOLUTION METHOD, AND HEAD-RELATED TRANSFER FUNCTION CONVOLUTION DEVICE

CROSS REFERENCES TO RELATED APPLICATIONS

The present invention contains subject matter related to Japanese Patent Application JP 2008-034236 filed in the Japanese Patent Office on Feb. 15, 2008, the entire contents of which are incorporated herein by reference.

BACKGROUND OF THE INVENTION

1. Field of the Invention

The present invention relates to a method for measuring a head-related transfer function (hereafter abbreviated to "HRTF") for enabling a listener to hear a sound source situated in front or the like of the listener, during acoustic reproduction with an electric-acoustic unit such as an acoustic reproduction driver of headphones for example, which is disposed near the ears of the listener.

2. Description of the Related Art

In a case of the listener wearing the headphones on the head for example, and listening to acoustically reproduced signals with both ears, if the audio signals reproduced at the headphones are commonly-employed audio signals supplied to speakers disposed to the left and right in front of the listener, the so-called lateralization phenomenon, wherein the reproduced sound image stays within the head of the listener, occurs.

A technique called virtual sound image localization is disclosed in WO95/13690 Publication and Japanese Unexamined Patent Application Publication No. 03-214897, for example, as having solved this problem of the lateralization phenomenon. This virtual sound image localization enables the sound image to be virtually localized such that when reproduced with a headphone or the like, sound is perceived to be just as if it were being reproduced from speakers disposed to the left and right in front of the listener, and is realized as described below.

FIG. 10 is a diagram for describing a technique of virtual sound image localization in a case of reproducing two-channel stereo signals of left and right with two-channel stereo headphones, for example. As shown in FIG. 10, at a position nearby both ears of the listener regarding which placement of two acoustic reproduction drivers such as two-channel stereo headphones for example (an example of an electro-acoustic conversion unit) is assumed, microphones (an example of an acousto-electric conversion unit) ML and MR are disposed, and also speakers SPL and SPR are disposed at positions at which virtual sound image localization is desired.

In a state where a dummy head 1 (alternatively, this may be a human, the listener himself/herself) is present, an acoustic reproduction of an impulse for example, is performed at one channel, the left channel speaker SPL for example, and the impulse emitted by that reproduction is picked up with each of the microphones ML and MR and an HRTF for the left channel is measured. In the case of this example, the HRTF is measured as an impulse response.

In this case, the impulse response serving as the left channel HRTF includes an impulse response HLd of the sound waves from the left channel speaker SPL picked up with the microphone ML (hereinafter, referred to as "impulse response of left primary component"), and an impulse response HLc of the sound waves from the left channel speaker SPL picked up with the microphone MR (hereinafter, referred to as "impulse response of left crosstalk component").

Next, an acoustic reproduction of an impulse is performed at the right channel speaker SPR in the same way, and the impulse emitted by that reproduction is picked up with each of the microphones ML and MR and an HRTF for the right channel, i.e., the HRTF of the right channel, is measured as an impulse response. In this case, the impulse response serving as the right channel HRTF includes an impulse response HRd of the sound waves from the right channel speaker SPR picked up with the microphone MR (hereinafter, referred to as "impulse response of right primary component"), and an impulse response HRc of the sound waves from the right channel speaker SPR picked up with the microphone ML (hereinafter, referred to as "impulse response of right crosstalk component").

The impulse responses for the HRTF of the left channel and the HRTF of the right channel are convoluted, as they are, with the audio signals supplied to the acoustic reproduction drivers for the left and right channels of the headphones, respectively. That is to say, the impulse response of left primary component and impulse response of left crosstalk component, serving as the left channel HRTF obtained by measurement, are convoluted, as they are, with the left signal audio signals, and the impulse response of right primary component and impulse response of right crosstalk component, serving as the right channel HRTF obtained by measurement, are convoluted, as they are, with the right signal audio signals.

This enables sound image localization (virtual sound image localization) such that sound is perceived to be just as if it were being reproduced from speakers disposed to the left and right in front of the listener in the case or two-channel stereo audio of left and right for example, even though the acoustic reproduction is nearby the ears of the listener.

A case of two channels has been described above, but with a case of three or more channels, this can be performed in the same way by disposing speakers at the virtual sound image localization positions for each of the channels, reproducing impulses for example, measuring the HRTF for each channel, and convolute impulse responses of the HRTFs obtained by measurement as to the audio signals supplied to the drivers for the acoustic reproduction by the two channels, left and right, of the headphones.

SUMMARY OF THE INVENTION

As described above, with the related art, measured HRTFs are convoluted into the audio signals to be reproduced, as they are. However, the measured HRTFs still include the properties of the microphones serving as an audio-electric conversion unit used for measurement, speakers serving as the sound source at the time of measurement, the room where the measurement was performed, and so on, so there is a problem that the properties and sound quality of reproduced audio is affected by the properties of the microphones used for measurement, the speakers serving as the sound source at the time of measurement, and the room or place where the measurement was performed.

In order to eliminate the effects of properties of the microphones and speakers, using expensive microphones and speakers having excellent properties with flat frequency properties as the microphones and speakers used for measuring the HRTFs. However, even such expensive microphones and speakers do not yield ideally flat frequency properties, so there have been cases wherein the effects of the properties of such microphones and speakers could not be completely eliminated, leading to deterioration in the sound quality of the reproduced audio.

Also, eliminating the properties of the microphones and speakers can be conceived by correcting audio signals following convolution of the HRTFs, using inverse properties of the measurement system microphones and speakers, but in this case, there is the problem that a correction circuit has to be provided to the audio signal reproduction circuit, so the configuration becomes complicated, and also correction complete eliminating the effects of the measurement system is difficult.

On the other hand, in order to eliminate properties of the room or place where measurement is performed, measuring in an anechoic chamber, where there are no reflections from the floor, ceiling, walls, and so forth, can be conceived. However, in the event of convoluting HRTFs measured in an anechoic chamber as they are into audio signals, there is a problem that virtual sound image localization and orientation are somewhat fuzzy. Accordingly, the related art, measurement of HRTF to be used as they are for convolution with audio signals is not performed in an anechoic chamber, but rather, HRTFs are measured in a room with a certain amount of reverberation. Further, there has been proposed an arrangement wherein a menu of rooms or places where the HRTFs were measured, such as a studio, hall, large room, and so forth, being presented to the user, so that the user who wants to enjoy music with virtual sound image localization can select the HRTF of a desired room or place from the menu.

Accordingly, with the related art, measurement of a general-purpose HRTF with the effects of the measured room or place eliminated, is basically not performed. Also, as described above, with the HRTF measurement method according to the related art, normally, speakers are situated at a sound source position to be perceived in virtual sound image localization, and measurement of HRTFs is performed with not only impulse responses of direct waves from the perceived sound source position but also accompanying impulse responses from reflected waves (without being able to separate the impulse response of direct waves and reflected waves, including both). That is to say, with the related art, there is no obtaining of HRTFs for each of sound waves from a particular direction as viewed from the measurement point position (i.e., sound waves directly reaching the measurement point without including reflected waves).

However, if HRTFs could be obtained regarding direct waves from the sound source position from which sound waves reflected off of walls and the like have been eliminated, a simulation such as with the following could be easily performed. That is to say, with consideration to reflected waves which enter the measurement position following having been reflected off of a predetermined wall from the perceived sound source position, the reflected sound waves from the wall following reflection off of the wall can be considered to be direct waves of sound waves from the reflection portion direction at the wall. Properties such as the degree of reflection and degree of sound absorption due to the material of the wall and so for can be perceived as gain of the direct waves from the wall.

Accordingly, if we convolute impulse responses from direct waves from the perceived sound source position to the measurement point for example, as they are, with no attenuation, while with regard to the reflected source wave components from the wall, impulse responses from direct waves from the sound source perceived in the reflection position direction of the wall are convoluted at an attenuation rate corresponding to the degree of reflection or degree of sound absorption, and the reproduced sound is listened to, what sort of virtual sound image localization state will be obtained, depending on the degree of reflection or degree of sound absorption according to the wall properties, can be verified.

Also, acoustic reproduction from convolution in audio signals of HRTFs of direct waves and HRTFs of selected reflected waves, taking into consideration the attenuation rate, enables simulation of virtual sound image localization in various room environments and place environments. This can be realized by separating direct waves and reflected waves from the perceived sound source position, and measuring as HRTFs. As described above, HRTFs of reflected waves can me measured by taking the direction of sound waves following reflect off of a wall or the like as the sound source direction. As described above, HRTFs regarding direct waves from which the reflected wave components have been eliminated can be obtained by measuring in an anechoic chamber, for example.

However, even if HRTFs can be obtained in an anechoic chamber, the properties of the speakers and microphones of the measurement system described above are not completely eliminated, and accordingly the problem that the results of the above-described simulation are affected by the properties of the speakers and microphones are unavoidable.

It has been found desirable to provide an HRTF measurement method and device enabling ideal HRTFs regarding only a perceived sound source position to be obtained, with the effects of the measurement system eliminated.

A head-related transfer function measurement method according to an embodiment of the present invention includes the steps of: first measuring which further includes placing an acousto-electric conversion unit nearby both ears of a listener where placement of an electro-acoustic conversion unit is assumed, picking up sound waves emitted at a perceived sound source position with the acousto-electric conversion unit in a state where a dummy head or a human exists at the listener position, and measuring a head-related transfer function from only the sound waves directly reaching the acousto-electric conversion unit; second measuring which further includes picking up sound waves emitted at a perceived sound source position with the acousto-electric conversion unit in a state where no dummy head or human exists at the listener position, and measuring a natural-state transfer property from only the sound waves directly reaching the acousto-electric conversion unit; normalizing the head-related transfer function measured by the first measuring with the natural-state transfer property measured by the second measuring to obtain a normalized head-related transfer function; and storing the normalized head-related transfer function obtained by the normalizing in a storage unit.

With this HRTF measurement method, in the first measuring, an HRTF including the property of the measurement system is measured from only the sound waves directly reaching the acousto-electric conversion unit from the perceived sound source position. Also, in the second measuring, a natural-state transfer property of a state where no dummy head or human exists is measured including the property of the measurement system under the same condition as with the first measuring.

In the normalizing, the HRTF measured by the first measuring is normalized with the natural-state transfer property measured by the second measuring, so as to obtain a normalized HRTF. The HRTF measured by the first measuring and the natural-state transfer property measured by the second measuring both include the property of the measurement system, so the only difference is whether or not a dummy head or human exists at the listener position.

Accordingly, the normalized HRTF obtained in the normalizing is an ideal HRTF in a state where the property of the measurement system has been eliminated, and this is stored in the storage unit.

Also, in the normalizing, an amount of data equivalent to the time from the sound waves emitted at the perceived sound source position to directly reach the acousto-electric conversion unit may be eliminated from the head-related transfer function and the natural-state transfer property obtained in the first measuring and the second measuring, with the normalization processing being performed.

With this configuration, the normalized HRTF is measured with delay time removed of an amount corresponding to the distance between the position of an acousto-electric conversion unit such as a microphone for example, and an emission position of a measurement wave such as impulses for example (equivalent to virtual sound image localization position) having been eliminated, so an HRTF can be obtained which is unrelated to the distance between the listener and virtual sound image localization in the direction of the virtual sound image localization position as viewed from the listener position. Accordingly, at the time of convoluting the obtained normalized HRTF into the audio signals, all that has to be given consideration is delay time corresponding to the distance between the virtual sound image localization position and the listener.

Also, a head-related transfer function measurement method according to an embodiment of the present invention includes the steps of: first measuring which further includes placing an acousto-electric conversion unit nearby both ears of a listener where placement of an electro-acoustic conversion unit is assumed, picking up sound waves emitted at a perceived sound source position with the acousto-electric conversion unit in a state where a dummy head or a human exists at the listener position, and measuring a head-related transfer function from only the sound waves directly reaching the acousto-electric conversion unit; second measuring which further includes picking up sound waves emitted at a perceived sound source position with the acousto-electric conversion unit in a state where no dummy head or human exists at the listener position, and measuring a natural-state transfer property from only the sound waves directly reaching the acousto-electric conversion unit; normalizing the head-related transfer function measured by the first measuring with the natural-state transfer property measured by the second measuring to obtain a normalized head-related transfer function; storing the normalized head-related transfer function obtained by the normalizing in a storage unit; and convoluting which further includes reading out the normalized head-related transfer function stored in the storage unit in the storing, and performing convolution on audio signals supplied to the electro-acoustic conversion unit.

A normalized HRTF that has been measured with configuration according to an embodiment of the present invention described earlier and stored in the storage unit can be convoluted in audio signals to be reproduced.

Also, in the normalizing, an amount of data equivalent to the time from the sound waves emitted at the perceived sound source position to directly reach the acousto-electric conversion unit may be eliminated from the head-related transfer function and the natural-state transfer property obtained in the first measuring and the second measuring, with the normalization processing being performed, and in the convoluting, audio signals to be supplied to the electro-acoustic conversion unit may be displayed by an amount of time corresponding to the distance between a perceived virtual sound image localization position and the position of the electro-acoustic conversion unit, with the normalized head-related transfer function stored in the storage unit in the storing being convoluted in the delayed audio signals.

With this configuration, the normalized HRTF is measured with delay time removed of an amount corresponding to the distance between the position of the acousto-electric conversion unit such as a microphone for example, and an emission position of a measurement wave such as impulses for example (equivalent to virtual sound image localization position) having been eliminated, so an HRTF can be obtained which is unrelated to the distance between the listener and virtual sound image localization in the direction of the virtual sound image localization position as viewed from the listener position. Accordingly, virtual sound image localization can be achieved at the intended virtual sound image localization position by convoluting the obtained normalized HRTF in audio signals delayed by delay time corresponding to the distance between the virtual sound image localization position and the listener.

According to the above configurations, an ideal HRTF in a state of measurement system property having been eliminated is obtained as a normalized HRTF, and can be convoluted in audio signals.

DESCRIPTION OF THE PREFERRED EMBODIMENTS

Description of HRTF Measurement Method

Figure 1:
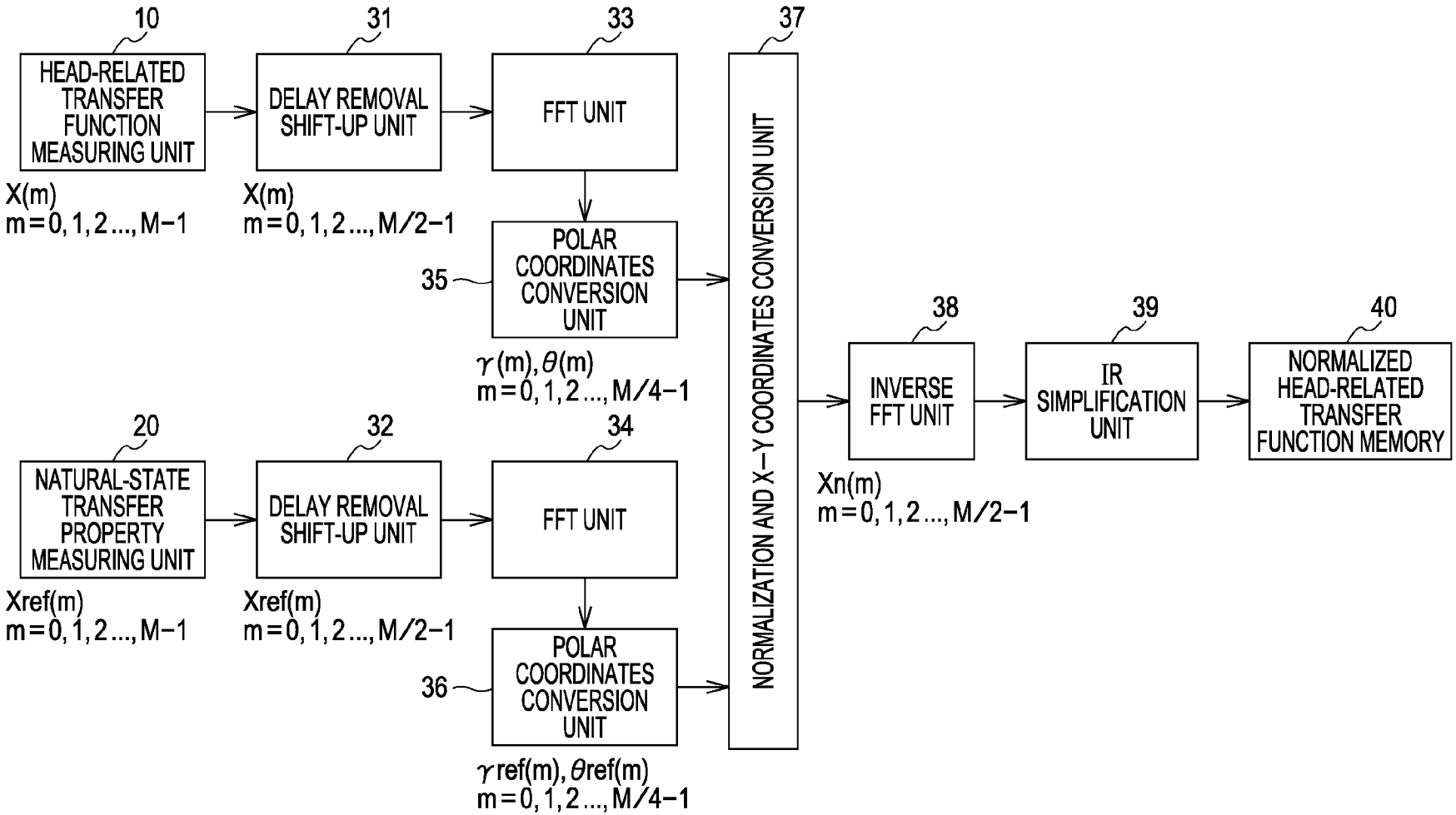
FIG. 1 is a block diagram of a system configuration example to which an HRTF (head-related transfer function) measurement method according to an embodiment of the present invention is to be applied.

First, an HRTF (head-related transfer function) measurement method according to an embodiment of the present invention will be described with reference to the drawings. FIG. 1 is a block diagram of a configuration example of a system for executing processing procedures for obtaining data for a normalization HRTF used with the HRTF measurement method according to an embodiment of the present invention. With this example, an HRTF measurement unit 10 performs measurement of HRTFs in an anechoic chamber, in order to measure head-related transfer properties of direct waves alone.

With the HRTF measurement unit 10, in the anechoic chamber, a dummy head or an actual human serving as the listener is situated at the position of the listener, and microphones serving as an acousto-electric conversion unit for collecting sound waves for measurement are situated at positions (measurement point positions) nearby both ears of the dummy head or human, where an electro-acoustic conversion unit for performing acoustic reproduction of audio signals in which the HRTFs have been convoluted are placed.

In a case where the electro-acoustic conversion unit for performing acoustic reproduction of audio signals in which the HRTFs have been convoluted are headphones with two channels of left and right for example, a microphone for the left channel is situated at the position of the headphone driver of the left channel, and a microphone for the right channel is situated at the position of the headphone driver of the right channel.

Also, a speaker serving as an example of a measurement sound source is situated at one of the directions regarding which an HRTF is to be measured, and in this state, measurement sound waves for the HRTF, impulses in this case, are reproduced from this speaker, and impulse responses are picked up with the two microphones. Note that in the following description, a position in a direction regarding which an HRTF is to be measured, where the speaker for the measurement sound source is placed, will be referred to as a "perceived sound source position".

Note that the direction of the perceived sound source position includes not only cases corresponding to the direction of the virtual sound image localization, but also includes the direction of reflected waves input to the measurement point having been reflected off of a wall or the like, upon the virtual sound image localization position having been determined.

With the HRTF measurement unit 10, the impulse responses obtained from the two microphones represent HRTFs. With this embodiment, the measurement at the HRTF measurement unit 10 corresponds to a first measuring.

With a natural-state transfer property measurement unit 20, measurement of natural-state transfer properties is performed under the same environment as with the HRTF measurement unit 10. That is to say, with this example, the transfer properties in the natural state are measured in an anechoic chamber in the same way, to measure the natural-state transfer properties with regard to the direct waves alone. With the natural-state transfer property measurement unit 20, the dummy head or human situated with the HRTF measurement unit 10 in the anechoic chamber is removed, a natural state with no obstacles between the speakers which are the perceived sound source position and the microphones is created, and with the placement of the speakers which are the perceived sound source position and the microphones being exactly the same state as with the HRTF measurement unit 10, in this state, measurement sound waves, impulses in this example, are reproduced by perceived sound source position speakers, and the impulse responses are picked up with the two microphones.

The impulse responses obtained form the two microphones with the natural-state transfer property measurement unit 20 represent natural-state transfer properties with no obstacles such as the dummy head or human. With this embodiment, the measurement by this natural-state transfer property measurement unit 20 corresponds to a second measuring.

Note that with the HRTF measurement unit 10 and the natural-state transfer property measurement unit 20, the above-described HRTFs and natural-state transfer properties for the left and right primary components, and HRTFs and natural-state transfer properties for the left and right crosstalk components, are obtained from each of the two microphones. Later-described normalization processing is performed for each of the primary components and left and right crosstalk components. In the following description, normalization processing will be described regarding only the primary components for example, and description of normalization processing regarding the crosstalk components will be omitted, to facilitate description. Of course, normalization processing is performed in the same way regarding the crosstalk components, as well.

The impulse responses obtained with the HRTF measurement unit 10 and the natural-state transfer property measurement unit 20 are output of digital data of 8,192 samples at a sampling frequency of 96 kHz with this example.

Now, the data of the HRTF obtained from the HRTF measurement unit 10 is presented as X(m), where m=0, 1, 2 . . . , M−1 (M=8192), and data of the natural-state transfer property obtained from the natural state transfer property measurement unit 20 is presented as Xref(m), where m=0, 1, 2 . . . , M−1 (M=8192).

The HRTF data X(m) from the HRTF measurement unit 10 and the natural-state transfer property data Xref(m) from the natural-state transfer property measurement unit 20 are subjected to removal of data of the head portion from the point in time at which reproduction of impulses was started at the speakers, by an amount of delay time equivalent to the arrival time of sound waves from the speaker at the perceived sound source location to the microphones for obtaining pulse responses, by delay removal shift-up units 31 and 32, and also at the delay removal shift-up units 31 and 32 the number of data is reduced to a number of data of a power of two, such that orthogonal transform from time-axial data to frequency-axial data can be performed next downstream.

Next, the HRTF data X(m) and the natural-state transfer property data Xref(m), of which the number of data has been reduced at the delay removal shift-up units 31 and 32, are supplied to FFT (Fast Fourier Transform) units 33 and 34 respectively, and transformed from time-axial data to frequency-axial data. Note that with the present embodiment, the FFT units 33 and 34 perform Complex Fast Fourier Transform (Complex FFT) which takes into consideration the phase.

Due to the complex FFT processing at the FFT unit 33, the HRTF data X(m) is transformed to FFT data made up of a real part R(m) and an imaginary part jI(m), i.e., R(m)+jI(m).

Also, due to the complex FFT processing at the FFT unit 34, the natural-state transfer property data Xref(m) is transformed to FFT data made up of a real part Rref(m) and an imaginary part jIref(m), i.e., Rref(m)+jIref(m).

The FFT data obtained from the FFT units 33 and 34 are X-Y coordinate data, and with this embodiment, further polar coordinates conversion units 35 and 36 are used to convert the FFT data into polar coordinates data. That is to say, the HRTF FFT data R(m)+jI(m) is converted by the polar coordinates conversion unit 35 into a radius γ(m) which is a size component, and an amplitude θ(m) which is an angle component.

The radius γ(m) and amplitude θ(m) which are the polar coordinates data are sent to a normalization and X-Y coordinates conversion unit 37.

Also, the natural-state transfer property FFT data Rref(m)+jIref(m) is converted by the polar coordinates conversion unit 35 into a radius γref(m) and an amplitude θref(m). The radius γref(m) and amplitude θref(m) which are the polar coordinates data are sent to the normalization and X-Y coordinates conversion unit 37.

At the normalization and X-Y coordinates conversion unit 37, first, the HRTF measured including the dummy head or human is normalized using the natural-state transmission property where there is no obstacle such as the dummy head. Specific computation of the normalization processing is as follows.

With the radius following normalization as γn(m) and the amplitude following normalization as θn(m), $$\gamma n(m)=\gamma(m)/\gamma\mathrm{ref}(m)$$

$$\theta n(m)=\theta(m)/\theta\mathrm{ref}(m) \qquad \text{(Expression 1)}$$

holds.

Next at the normalization and X-Y coordinates conversion unit 37, the polar coordinate system data following normalization processing, the radius γn(m) and the amplitude θn(m), is converted into normalized HRTF data of frequency-axial data of the real part Rn(m) and imaginary part jIn(m) (m=0, 1 . . . M/4−1) of the X-Y coordinate system.

The normalized HRTF data of the frequency-axial data of the X-Y coordinate system is transformed into impulse response Xn(m) which is normalized HRTF data of the time-axis at an inverse FFT unit 38. The inverse FFT unit 38 performs Complex Inverse Fast Fourier Transform (Complex Inverse FFT).

That is to say, computation of $$Xn(m)=\mathrm{IFFT}(Rn(m)+j\mathrm{In}(m))$$

where m=0, 1, 2 . . . M/2−1, is performed at the Inverse FFT (IFFT (Inverse Fast Fourier Transform)) unit 38, which obtains the impulse response Xn(m) which is time-axial normalized HRTF data.

The normalized HRTF data Xn(m) from the inverse FFT unit 38 is simplified to impulse property tap length which can be processed (which can be convoluted, described later), at an IR (impulse response) simplification unit 39. With this embodiment, this is simplified to 600 taps (600 pieces of data from the head of the data from the inverse FFT unit 38).

The normalized HRTF data Xn(m) (m=0, 1 . . . 599) simplified at the IR simplification unit 39 is written to the normalized HRTF memory 40 for later-described convolution processing. Note that the normalized HRTF written to this normalized HRTF memory 40 includes a normalized HRTF which is a primary component, and a normalized HRTF which is a crosstalk function, at each of the perceived sound source positions (virtual sound image localization positions), as described earlier.

In FIG. 1, portions excluding the HRTF measurement unit 10, the natural-state transfer property measurement unit 20, and the normalized HRTF memory 40, make up a processing corresponding to normalizing.

The description above has been description regarding processing for obtaining normalized HRTFs as to a speaker position in a case where a speaker for reproducing impulses as an example of measurement sound waves is situated at one perceived sound source position separated from a microphone position with a measurement point position by a predetermined distance, in one particular direction as to a listener position.

With this embodiment, the perceived sound source position, which is the position at which the speaker for reproducing the impulses serving as the example of a measuring sound wave is positioned, is changed variously in different directions as to the measurement point position, with a normalized HRTF being obtained for each perceived sound source position.

Now, the perceived sound source position which is the speaker placement position is changed in increments of 10 degrees at a time for example, which is a resolution for a case of taking into consideration the direction of sound waves input to the measurement point position, over an angular range of 360 degrees or 180 degrees center on the microphone position or listener which is the measurement position, following having changed the perceived sound source position various, and reflected off of walls as described later.

A case of taking into consideration an angular range of 360 degrees is a case assuming reproduction of multi-channel surround-sound audio such as 5.1 channels, 6.1 channels, 7.1 channels, and so forth. A case of taking into consideration an angular range of 180 degrees is a case assuming that the virtual sound image localization position is only in front of the listener, or a state where there are no reflected waves from a wall behind the listener.

Also, with this embodiment, the position where the microphones are situated is changed in the measurement method of the HRTF and natural-state transfer property, in accordance with the position of acoustic reproduction drivers such as the drivers of the headphones actually supplying the reproduced sound to the listener.

Figure 2B:
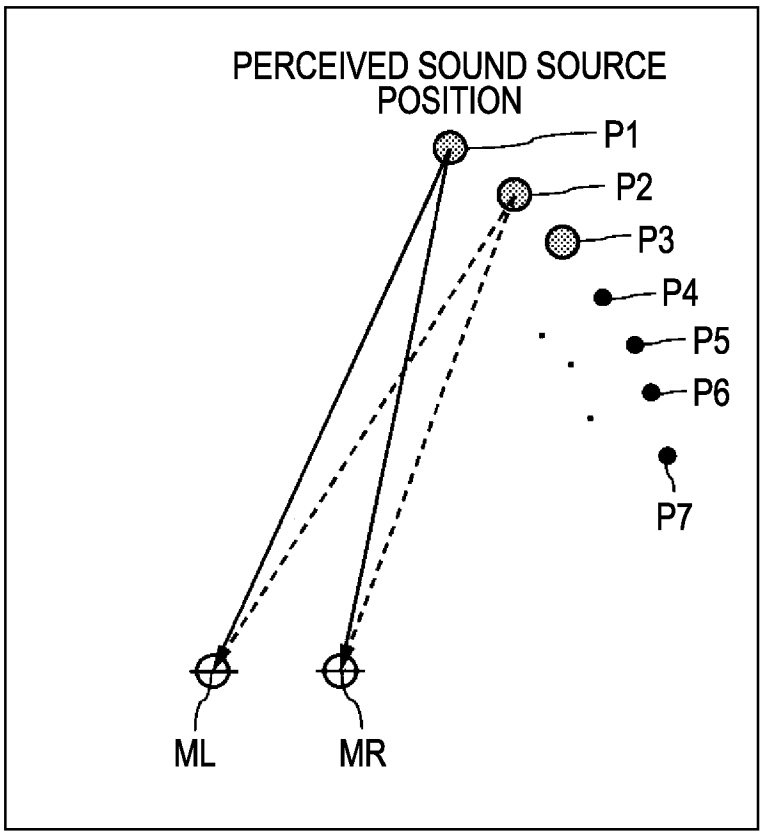
FIGS. 2A and 2B are diagrams for describing HRTF and natural-state transfer property measurement positions with the HRTF measurement method according to an embodiment of the present invention.
Figure 2A:
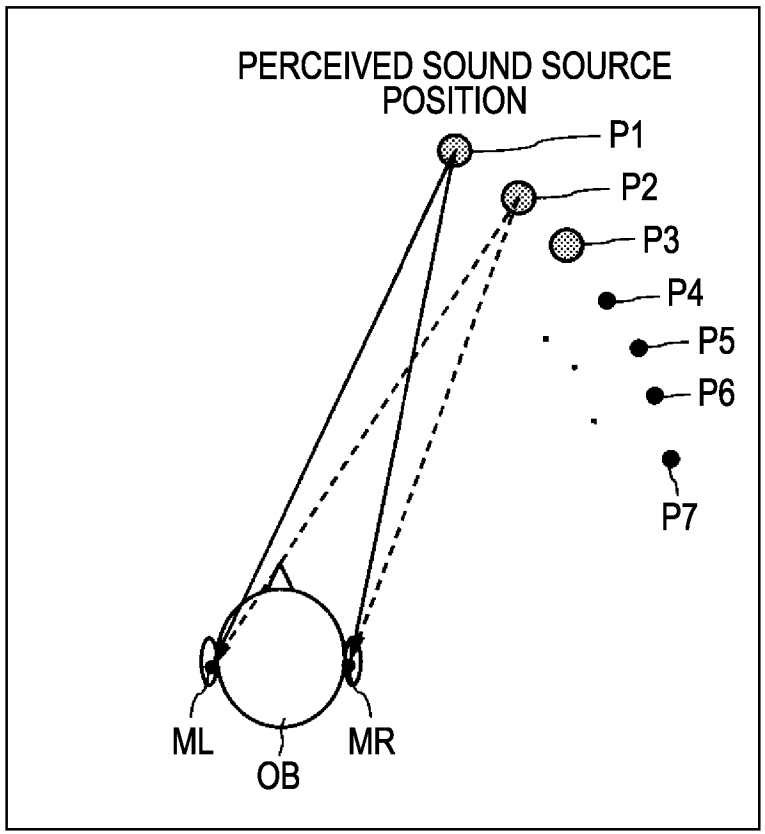

FIGS. 2A and 2B are diagrams for describing HRTF and natural-state transfer property measurement positions (perceived sound source positions) and microphone placement positions serving as measurement point positions, in a case wherein the acoustic reproduction unit serving as electro-acoustic conversion unit for actually supplying the reproduced sound to the listener are inner headphones.

Specifically, FIG. 2A illustrates a measurement state with the HRTF measurement unit 10 where the acoustic reproduction unit for supplying the reproduced sound to the listener are inner headphones, with a dummy head or human OB situated at the listener position, and with the speaker for reproducing impulses at the perceived sound source positions being situated at predetermined positions in the direction regarding which HRTFs are to be measured, at 10 degree intervals, centered on the listener position or the center position of the two driver positions of the inner headphones, in this example, as indicated by dots P1, P2, P3, . . . .

Also, with this example of the case of the inner headphones, the two microphones ML and MR are situated at positions within the auditory capsule positions of the ears of the dummy head or human, as shown in FIG. 2A.

FIG. 2B shows a measurement environment state wherein the dummy head or human OB in FIG. 2A has been removed, illustrating a measurement state with the natural-state transfer property measurement unit 20 where the electro-acoustic conversion unit for supplying the reproduced sound to the listener are inner headphones.

The above-described normalization processing is carried out by normalizing HRTFs at each perceived sound source position, measured by a speaker reproducing impulses at each of the perceived sound source positions indicated by dots P1, P2, P3, . . . in FIG. 2A, and obtaining these with microphones ML and MR, the normalization being performed with the normal-state transfer properties with the dummy head or human OB removed, measured in FIG. 2B at the same perceived sound source positions indicated by dots P1, P2, P3, . . . as with FIG. 2A. For example, an HRTF measured at the perceived sound source position P1 is normalized with the natural-state transfer property measured at the same perceived sound source position P1.

Figure 3:
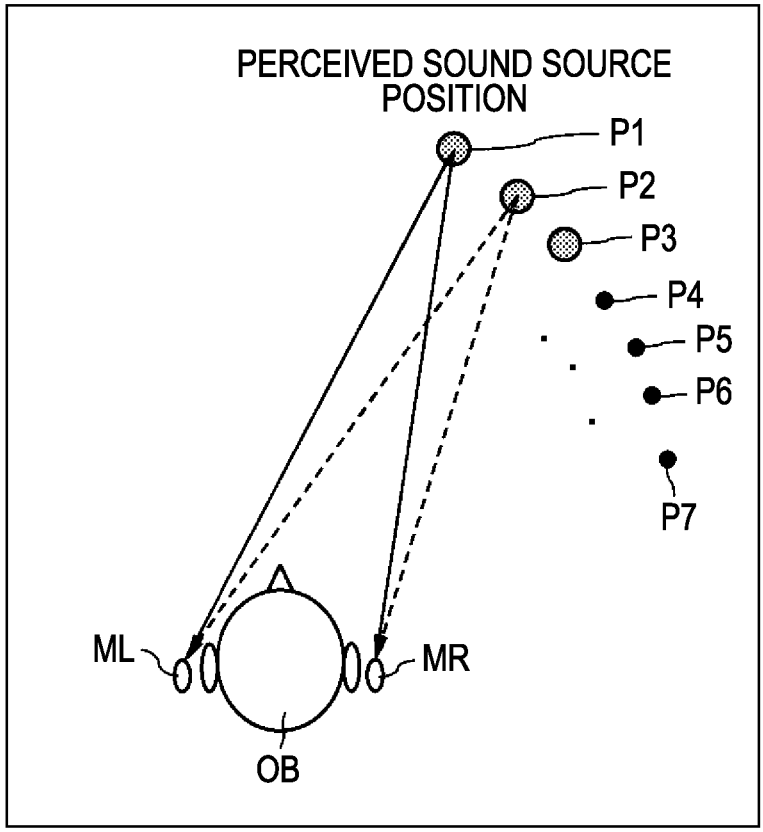
FIG. 3 is a diagram for describing the measurement position of HRTFs in the HRTF measurement method according to an embodiment of the present invention.

Next, FIG. 3 is a diagram for describing the perceived sound source position and microphone placement position at the time of measuring HRTFs and natural-state transfer properties in the case that the acoustic reproduction unit for supplying the reproduced sound to the listener is over-head headphones. More specifically, FIG. 3 illustrates a measurement state with the HRTF measurement unit 10 where the acoustic reproduction unit for supplying the reproduced sound to the listener are over-head headphones, with a dummy head or human OB being positioned at the listener position, and with the speaker for reproducing impulses at the perceived sound source positions being situated at predetermined positions in the direction regarding which HRTFs are to be measured, at 10 degree intervals, centered on the listener position or the center position of the two driver positions of the over-head headphones, in this example, as indicated by dots P1, P2, P3, . . . . Also, the two microphones ML and MR are situated at positions nearby the ears facing the auditory capsules of the ears of the dummy head or human, as shown in FIG. 3.

The measurement state at the natural-state transfer property measurement unit 20 in the case that the acoustic reproduction unit is over-head headphones is a measurement environment wherein the dummy head or human OB in FIG. 3 has been removed. In this case as well, it is needless to say that measurement of the HRTFs and natural-state transfer properties, and the normalization processing, are performed in the same way as with FIGS. 2A and 2B.

Figure 4:
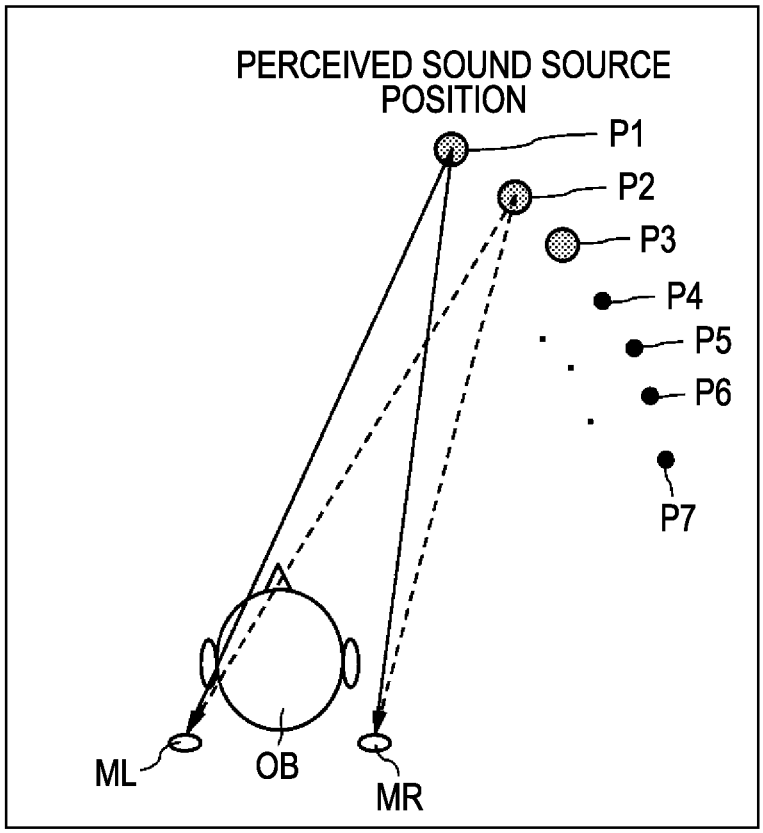
FIG. 4 is a diagram for describing the measurement position of HRTFs in the HRTF measurement method according to an embodiment of the present invention.

Next, FIG. 4 is a diagram for describing the perceived sound source position and microphone placement position at the time of measuring HRTFs and natural-state transfer properties in the case of placing electro-acoustic conversion unit serving as acoustic reproduction unit for supplying the reproduced sound to the listener, speakers for example, in a headrest portion of a chair in which the listener sits, for example. More specifically, FIG. 4 illustrates a measurement state with the HRTF measurement unit 10 where the acoustic reproduction unit for supplying the reproduced sound to the listener are speakers positioned in a headrest portion of a chair, with a dummy head or human OB being positioned at the listener position, and with the speaker for reproducing impulses at the perceived sound source positions being situated at predetermined positions in the direction regarding which HRTFs are to be measured, at 10 degree intervals, centered on the listener position or the center position of the two speaker positions placed in the headrest portion of the chair, in this example, as indicated by dots P1, P2, P3, . . . . Also, as shown in FIG. 4, the two microphones ML and MR are situated at positions behind the head of the dummy head or human and nearby the ears of the listener, which is equivalent to the placement positions of the speakers attached to the headrest of the chair.

The measurement state at the natural-state transfer property measurement unit 20 in the case that the acoustic conversion reproduction unit is electro-acoustic conversion drivers attached to the headrest of the chair is a measurement environment wherein the dummy head or human OB in FIG. 4 has been removed. In this case as well, it is needless to say that measurement of the HRTFs and natural-state transfer properties, and the normalization processing, are performed in the same way as with FIGS. 2A and 2B.

From the above, impulse responses from a virtual sound source position are measured in an anechoic chamber at 10 degree intervals, centered on the center position of the head of the listener or the center position of the electro-acoustic conversion unit for supplying audio to the listener at the time of reproduction, as shown in FIGS. 2A through 4, so HRTFs can be obtained regarding only direct waves from the respective virtual sound image localization positions, with reflected waves having been eliminated.

The obtained normalized HRTFs have properties of speakers generating the impulses and properties of the microphones picking up the impulses eliminated by normalization processing.

Further, the obtained normalized HRTFs have had a delay removed which corresponds to the distance between the position of speaker generating the impulses (perceived sound source position) and position of microphones for picking up the impulses (assumed driver positions), so this is irrelevant to the distance between the position of speaker generating the impulses (perceived sound source position) and position of microphones for picking up the impulses (assumed driver positions). That is to say, the obtained normalized HRTFs are HRTFs corresponding to only the direction of the speaker generating the impulses (perceived sound source position) as viewed from the position of microphones for picking up the impulses (assumed driver positions).

Accordingly, at the time of convolution of the normalized HRTF in the audio signals, providing a delay to the audio signals corresponding to the distance between the perceived sound source position and the assumed driver position enables acoustic reproduction with the distance position corresponding to the delay in the direction of the perceived sound source position as to the assumed driver positions as a virtual sound image localization position.

This relates to direct waves from the virtual sound image localization position in the case that the perceived sound source position is taken as the virtual sound image localization position, but with reflected waves from the direction of the perceived sound source position, this can be achieved by providing the audio signals with a delay corresponding to the path length of sound waves from the position at which virtual sound image localization is desired, reflected off of walls or the like, and input to the assumed driver position from the perceived sound source position.

Note that signal processing in the block diagram in FIG. 1 for describing an embodiment of the HRTF measurement method can be all performed by a DSP (Digital Signal Processor). In this case, the obtaining units of the HRTF data X(m) and natural-state transfer property data Xref(m) of the HRTF measurement unit 10 and natural-state transfer property measurement unit 20, the delay removal shift-up units 31 and 32, the FFT units 33 and 34, the polar coordinates conversion units 35 and 36, the normalization and X-Y coordinates conversion unit 37, the inverse FFT unit 38, and the IR simplification unit 39, can each be configured a DSP, or the entire signal processing can be configured of a single or multiple DSPs.

Note that with the example in FIG. 1 described above, data of HRTFs and natural-state transfer properties is subjected to removal of head data of an amount of delay time corresponding to the distance between the perceived sound source position and the microphone position at the delay removal shift-up units 31 and 32, in order to reduce the amount of processing regarding later-described convolution for the HRTFs, whereby data following that removed is shifted up to the head, and this data removal processing is performed using memory within the DSP, for example. However, in cases wherein this delay-removal shift-up can be done away with, the DSP may perform processing of the original data with the unaltered 8,192 samples of data.

Also, the IR simplification unit 39 is for reducing the amount of convolution processing at the time of the later-described convolution processing of the HRTFs, and accordingly this can be omitted.

Further, in the above-described embodiment, the reason that the frequency-axial data of the X-Y coordinate system from the FFT units 33 and 34 is converted into frequency data of a polar coordinate system is taking into consideration cases where normalization processing does not work in the state of frequency data of the X-Y coordinate system, so with an ideal configuration, normalization processing can be performed with frequency data of the X-Y coordinate system as it is.

Note that with the above-described example, normalized HRTFs are obtained regarding a great number of perceived sound source positions, but in the event that the virtual sound image localization position is fixed beforehand, obtaining normalized HRTFs for that fixed virtual sound image localization position is sufficient. For example, in a case of obtaining a sound field for virtual sound image localization for 5.1 channel surround, it is sufficient to perform measurement for HRTFs and natural-state transfer properties at six (the same properties can be used for the left and right, so actually four) perceived sound source positions corresponding to the 5.1 channel virtual sound image localization positions, and obtain the HRTFs.

Now, while measurement is performed in an anechoic chamber in the above-described embodiment in order to measure the HRTFs and natural-state transfer properties regarding only the direct waves from multiple perceived sound source positions, but direct wave components can be extracted even in rooms with reflected waves rather than an anechoic chamber, if the reflected waves are greatly delayed as to the direct waves, by applying a time window to the direct wave components.

Also, by using TSP (Time Stretched Pulse) signals instead of impulses for the measurement sound waves for HRTFs emitted by the speaker at the perceived sound source positions, reflected waves can be eliminated and HRTFs and natural-state transfer properties can be measured regarding direct waves alone even if not in an anechoic chamber.

Description of HRTF Convolution Method

Figure 5:
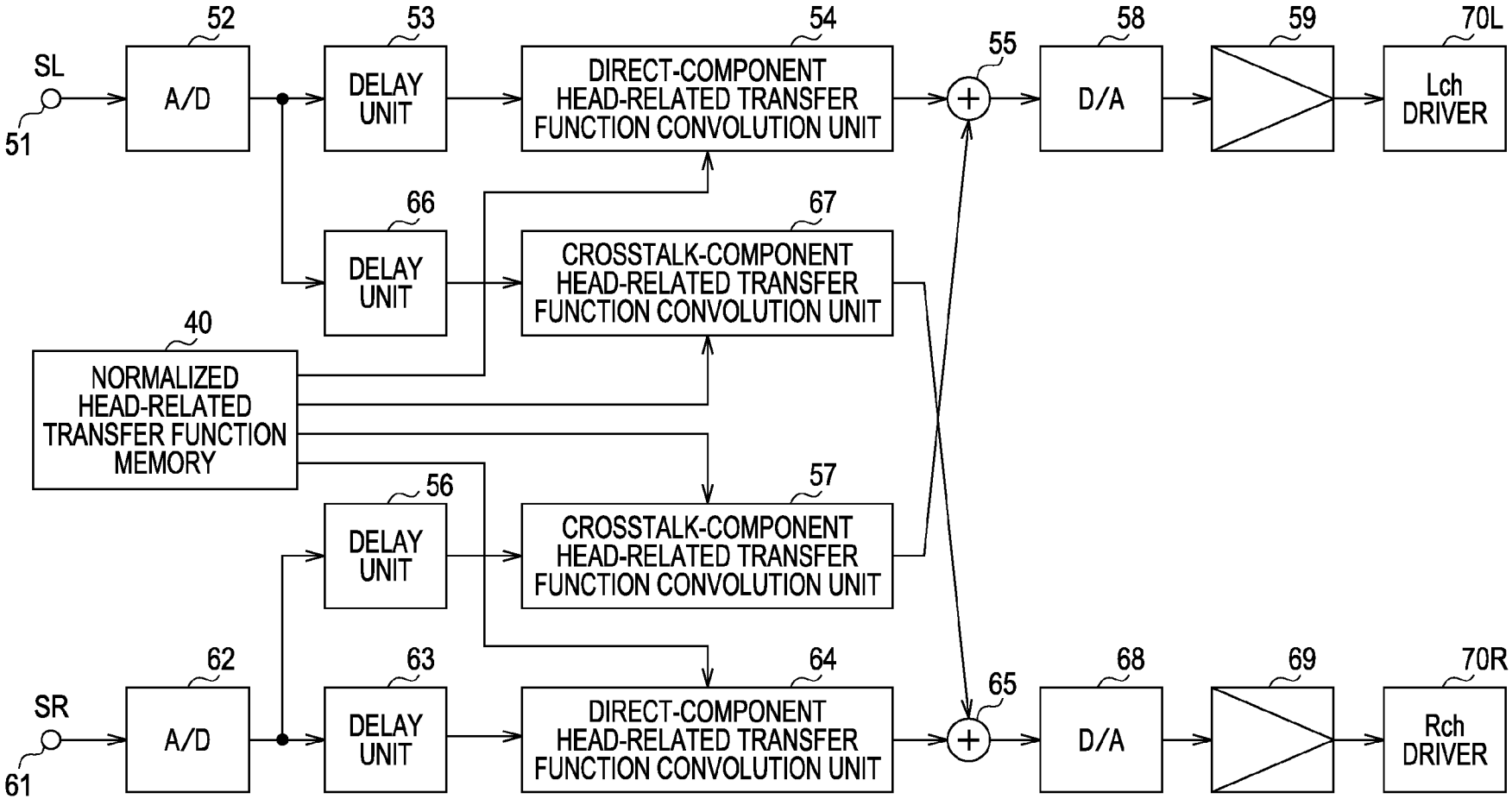
FIG. 5 is a block diagram illustrating a configuration of a reproduction device to which the HRTF convolution method according an embodiment of to the present invention has been applied.

Next, an HRTF convolution method according to an embodiment of the present invention will be described with reference to an example of application to a reproduction device capable of reproduction using virtual sound image localization position, by convoluting the normalized HRTFs stored as described above in the audio signals to be reproduced. FIG. 5 is a block diagram of the reproduction device in this example, which is a case of virtual sound image localization of two-channel stereo of left and right, and the left and right front of the listener. In this case, the drivers for reproducing sound are two-channel over-head headphones, for example. In the case of the example in this FIG. 5 as well, signal processing can be performed with a configuration using one or multiple DSPs.

In this example, of the two-channel stereo audio signals, the left-channel analog audio signals SL are supplied to an A/D converter 52 via an input terminal 51, and converted into digital audio signals DL. The digital audio signals DL are supplied to a primary-component HRTF convolution unit 54 via a delay unit 53. The delay amount at the delay unit 53 is equivalent to the distance between the position where virtual sound image localization is desired regarding the audio of the left channel, and the driver for the left channel of the over-head headphones.

The primary-component HRTF convolution unit 54 reads out from the normalized HRTF memory 40, of the main component normalized HRTF data Xn(m) stored in the normalized HRTF memory 40, the normalized HRTF data in the direction where virtual sound image localization of the left channel audio is desired, with reference to the listener position, and convoluted in the audio signals from the delay unit 53. The primary-component HRTF convolution unit 54 is configured of a 600-tap IIR (Infinite Impulse Response) filter or FIR (Finite Impulse Response) filter with this example. The output of this primary-component HRTF convolution unit 54 is then supplied to an adder 55.

Also, of the two-channel stereo audio signals, the right-channel analog audio signals SR are supplied to an A/D converter 62 and converted into digital audio signals DR. The digital audio signals DR are supplied to a primary-component HRTF convolution unit 64 via a delay unit 63. The delay amount at the delay unit 63 is equivalent to the distance between the position where virtual sound image localization is desired regarding the audio of the right channel, and the driver for the right channel of the over-head headphones.

The primary-component HRTF convolution unit 64 reads out from the normalized HRTF memory 40, of the main component normalized HRTF data Xn(m) stored in the normalized HRTF memory 40, the normalized HRTF data in the direction where virtual sound image localization of the right channel audio is desired, with reference to the listener position, and convoluted in the audio signals from the delay unit 63. The primary-component HRTF convolution unit 64 is configured of a 600-tap IIR filter or FIR filter with this example. The output of this primary-component HRTF convolution unit 64 is then supplied to an adder 65.

The digital audio signal DR from the A/D converter 62 is supplied to a crosstalk-component HRTF convolution unit 57 via a delay unit 56. The delay amount at the delay unit 56 is equivalent to the distance between the position where virtual sound image localization is desired regarding the audio of the right channel, and the driver for the left channel of the over-head headphones.

The crosstalk-component HRTF convolution unit 57 reads out from the normalized HRTF memory 40, of the main component normalized HRTF data Xn(m) stored in the normalized HRTF memory 40, the normalized HRTF data of the crosstalk component from the virtual sound source of the right channel position where virtual sound image localization is desired with this example to the left channel, and convoluted in the audio signals from the delay unit 56. The crosstalk-component HRTF convolution unit 57 is also configured of a 600-tap IIR filter or FIR filter with this example. The output of the crosstalk-component HRTF convolution unit 57 is supplied to the adder 55.

The digital audio signals of the added output from the adder 55 are returned back to analog audio signals by a D/A converter 58, supplied to a left channel driver 70L of the over-head headphones via an amplifier 59, and converted into acoustic sound.

The digital audio signal DL from the A/D converter 52 is ALSO supplied to a crosstalk-component HRTF convolution unit 67 via a delay unit 66. The delay amount at the delay unit 66 is equivalent to the distance between the position where virtual sound image localization is desired regarding the audio of the left channel, and the driver for the right channel of the over-head headphones.

The crosstalk-component HRTF convolution unit 67 reads out from the normalized HRTF memory 40, of the main component normalized HRTF data Xn(m) stored in the normalized HRTF memory 40, the normalized HRTF data of the crosstalk component from the virtual sound source of the left channel position where virtual sound image localization is desired with this example to the right channel, and convoluted in the audio signals from the delay unit 56. The crosstalk-component HRTF convolution unit 67 is also configured of a 600-tap IIR filter or FIR filter with this example. The output of the crosstalk-component HRTF convolution unit 67 is supplied to the adder 65.

The digital audio signals of the added output from the adder 65 are returned back to analog audio signals by a D/A converter 68, supplied to a right channel driver 70R of the overhead headphones via an amplifier 69, and converted into acoustic sound.

With the reproduction device shown in FIG. 5 described above, acoustic reproduction of sound can be performed which is equivalent to measuring HRTFs in an anechoic chamber with no reverberations, and convoluting the measured HRTFs in two-channel stereo audio signals.

In the event adding of predetermined reverberations, i.e., audio signal components reflected off of walls or the like from a virtual sound image localization position (perceived sound source position) is desired, the direction of the reflected audio signal component can be obtained from the assumed driver position, and normalized HRTFs in that direction can subjected to a corresponding delay and convoluted in audio signals of the two channels left and right.

Note that in the configuration in FIG. 5, the normalized HRTF memory 40, which stores the normalized HRTF data regarding a great number of virtual sound source positions, is used as it is, but in the event that the virtual sound image localization positions of the left and right positions has been determined, the normalized HRTF data convoluted at the primary-component HRTF convolution units 54 and 64, and the crosstalk-component HRTF convolution units 57 and 67, is particular data of the data stored in the normalized HRTF memory 40.

Figure 6B:
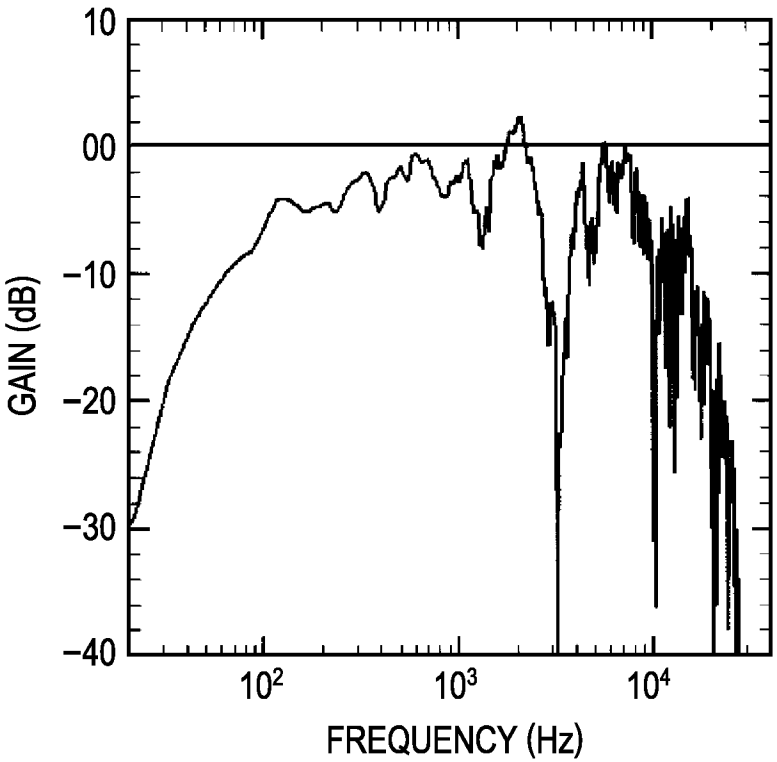
FIGS. 6A and 6B are diagrams illustrating an example of properties of measurement result data obtained by an HRTF measurement unit and a natural-state transfer property measurement unit with an embodiment of the present invention.
Figure 6A:
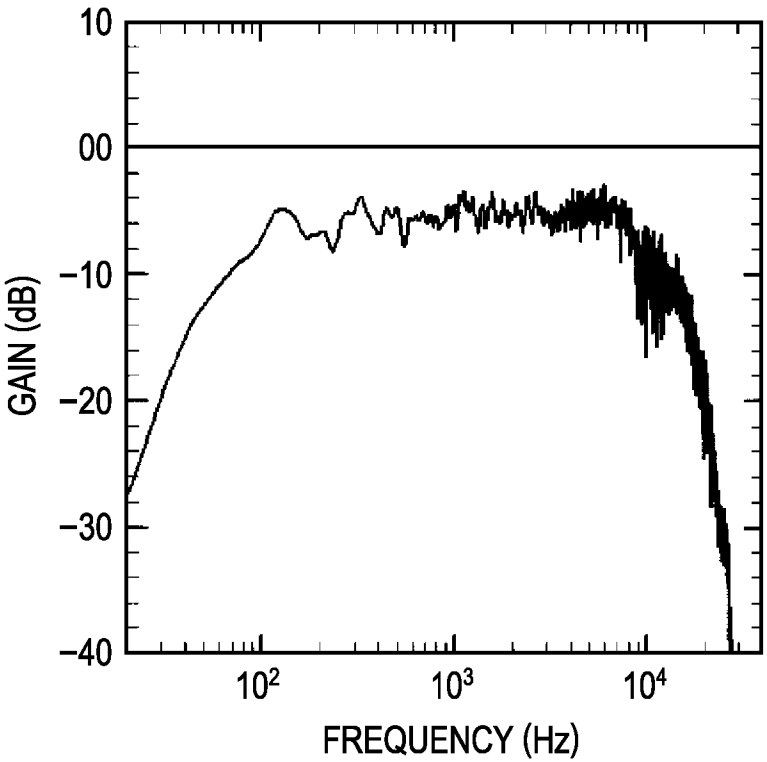

Accordingly, an arrangement may be made wherein a storage unit (register) for the normalized HRTF data to be convoluted is provided to each of the primary-component HRTF convolution units 54 and 64, and the crosstalk-component HRTF convolution units 57 and 67, with the normalized HRTFs to be convoluted being read out from the normalized HRTF memory 40 and stored beforehand. Validation of the Advantages of the Invention FIGS. 6A and 6B show properties of a measurement system including speakers and microphones actually used for measurement. FIG. 6A illustrates frequency properties of output signals from the microphones when sound of frequency signals from 0 to 20 kHz is reproduced at a same constant level by the speaker in a state where an obstacle such as the dummy head or human is not inserted, and picked up with the microphones.

The speaker used here is an industrial-use speaker which is supposed to have quite good properties, but even then properties as shown in FIG. 6A are exhibited, and flat frequency properties are not obtained. Actually, the properties shown in FIG. 6A are recognized as being excellent properties, belonging to a fairly flat class of general speakers.

With the related art, the properties of the speaker and microphones are added to the HRTF, and are not removed, so the properties and sound quality of the sound obtained with the HRTFs convoluted are effected of the properties of the speaker of and microphones.

FIG. 6B illustrates frequency properties of output signals from the microphones in a state that an obstacle such as a dummy head or human is inserted under the same conditions. It can be sent that there is a great dip near 1200 Hz and near 10 kHz, illustrating that the frequency properties change greatly.

Figure 7B:
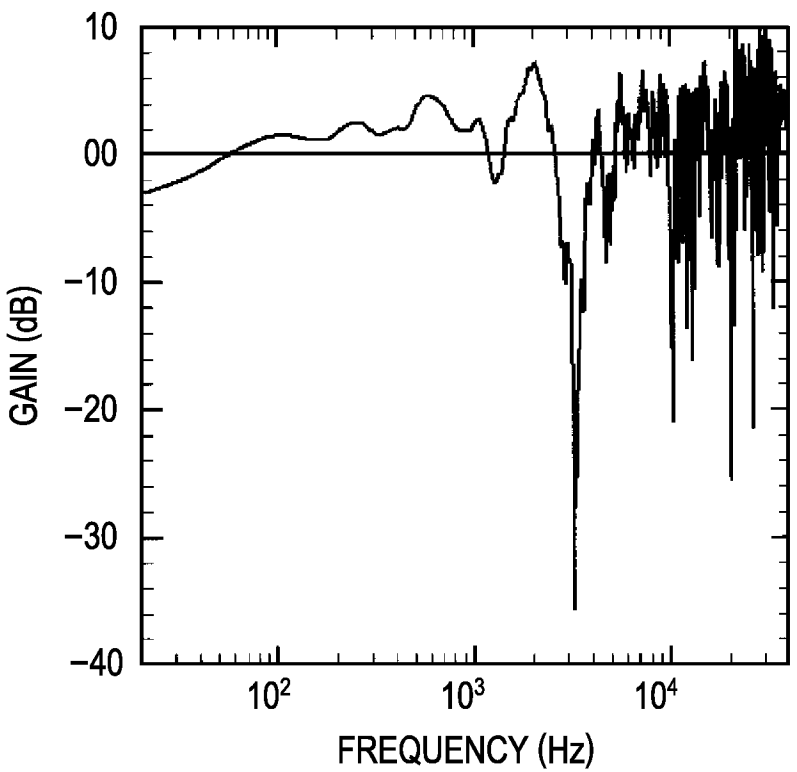
FIGS. 7A and 7B are diagrams illustrating an example of properties of normalized HRTFs obtained by an embodiment of the present invention.
Figure 7A:
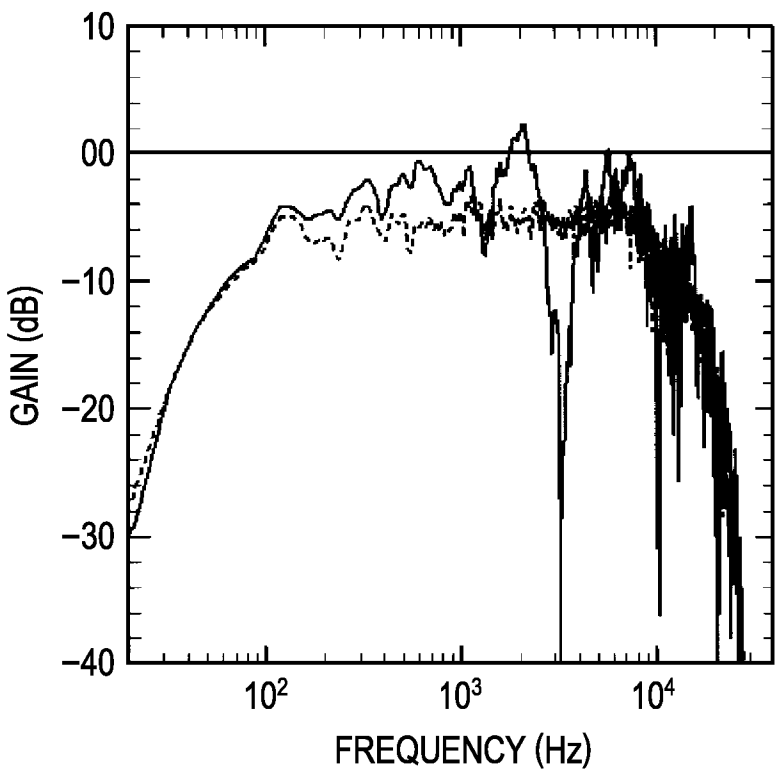

FIG. 7A is a frequency property diagram illustrating the frequency properties of FIG. 6A and the frequency properties of FIG. 6B overlaid. On the other hand, FIG. 7B illustrates normalized HRTF properties according to the embodiment described above. It can be sent form this FIG. 7B that gain does not drop with the normalized HRTF properties, even in the lowband.

With the embodiment according to the present invention described above, complex FFT processing is performed, and normalized HRTFs are used taking into consideration the phase component, so the normalized HRTFs are higher in fidelity as compared to cases of using HRTFs normalized only with the amplitude component.

Figure 8:
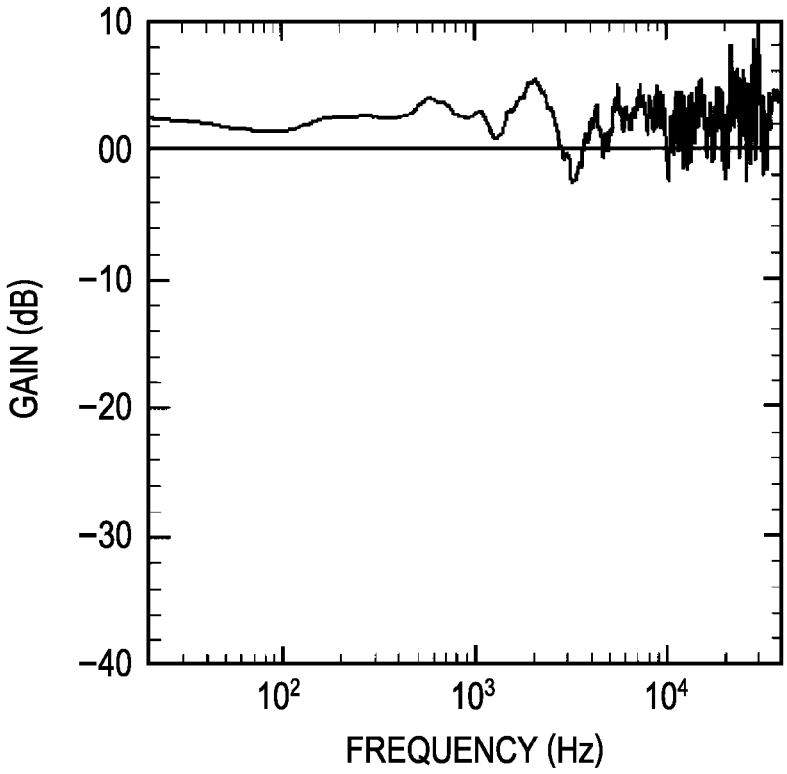
FIG. 8 is a diagram illustrating an example of properties to be compared with properties of normalized HRTFs obtained by an embodiment of the present invention.

An arrangement wherein processing for normalizing the amplitude alone without taking into consideration the phase is performed, and the impulse properties remaining at the end are subjected to FFT again to obtain properties, is shown in FIG. 8. As can be understood by comparing this FIG. 8 with FIG. 7B which is the properties of the normalized HRTF according to the present embodiment, the difference in property between the HRTF X(m) and natural-state transfer property Xref(m) is correctly obtained with the complex FFT as shown in FIG. 7B, but in a case of not taking the phase into consideration, this deviates from what it should be, as shown in FIG. 8.

Figure 9:
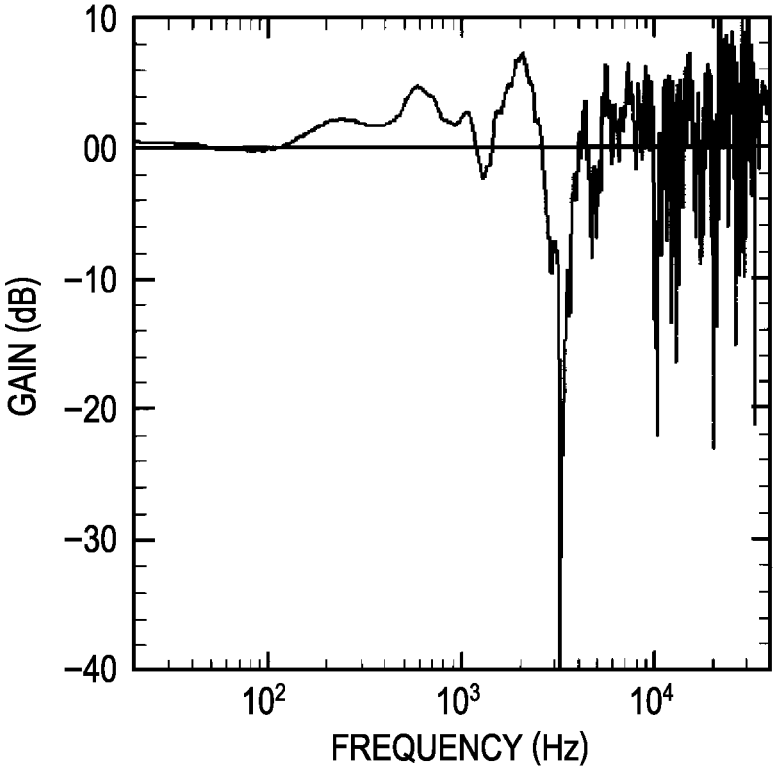
FIG. 9 is a diagram illustrating an example of properties to be compared with properties of normalized HRTFs obtained by an embodiment of the present invention.
Figure 10:
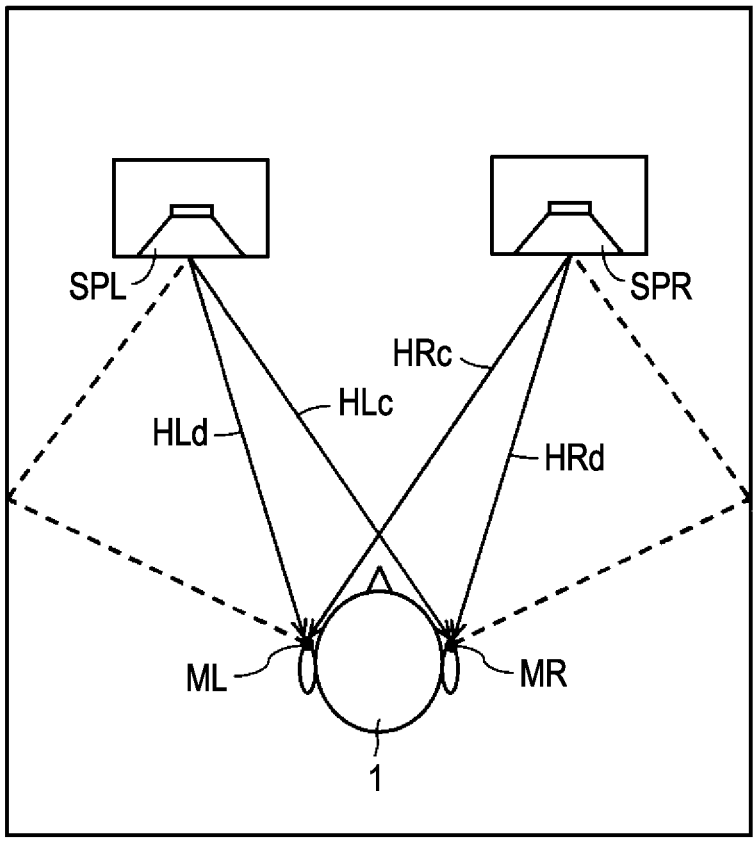
FIG. 10 is a diagram used for describing HRTFs.

Also, in the processing procedures in FIG. 1 described above, the IR simplification unit 39 performs simplification of the normalized HRTFs at the end, so deviation of properties is less as compared to a case where the number of data is reduced from the beginning. That is to say, in the event of performing simplification for reducing the number of data first for the data obtained with the HRTF measurement unit 10 and natural-state transfer property measurement unit 20 (case of performing normalization with those following the number of impulses used at the end as 0), the properties of the normalized HRTFs are as shown in FIG. 9, with particular deviation in lowband properties. On the other hand, the properties of the normalized HRTFs obtained with the configuration of the embodiment described above are as shown in FIG. 7B, with little deviation even in lowband properties.

Advantages of the Embodiment

With the related art, in the case of performing signal processing using HRTFs, properties of the measurement system were not removed, so the sound quality following the final convolution processing deteriorated unless good-sounding expensive speakers and microphones are used for measurement. On the other hand, with the normalized HRTFs according to the present embodiment, properties of the measurement system can be removed, so convolution processing with no deterioration in sound quality can be performed even if using a measurement system using inexpensive speakers and microphones without flat properties.

Further, while ideal properties (completely flat) are elusive, no matter how expensive and having good properties the speakers and microphones may be, with this embodiment HRTFs more ideal that any properties according to the related art can be obtained.

Also, HRTFs regarding only direct waves, with reflected waves eliminated, are obtained with various directions as to the listener for example as the virtual sound source position, so HRTFs regarding sound waves form each direction can be easily convoluted in the audio signals, and the reproduced sound field when convoluting the HRTFs regarding the sound waves for each direction can be readily verified.

For example, an arrangement may be made wherein, with the virtual sound image localization set to a particular position, not only HRTFs regarding direct waves from the virtual sound image localization position but also HRTFs regarding sound waves from a direction which can be assumed to be reflected waves from the virtual sound image localization position are convoluted, and the reproduced sound field can be verified, so as to perform verification such as which reflected waves of which direction are effective for virtual sound image localization, and so forth.

Other Embodiments

While the above description has been made regarding a case wherein headphones are primarily the electro-optical conversion unit for performing acoustic reproduction of audio signals to be reproduced, application can be made to applications where speakers are the output system, such as front surround and so forth, taking into consideration the measurement method and processing contents.

It should be understood by those skilled in the art that various modifications, combinations, sub-combinations and alterations may occur depending on design requirements and other factors insofar as they are within the scope of the appended claims or the equivalents thereof.

What is claimed is:

1. A head-related transfer function measurement method comprising steps of:

performing a first measuring in an environment including placing acousto-electric conversion means nearby both ears of a listener where placement of electro-acoustic conversion means is assumed, said acousto-electric conversion means being capable of picking up sound waves, picking up first sound waves emitted at a perceived sound source position with said acousto-electric conversion means in a state where a dummy head or a human exists at a listener position, and measuring a head-related transfer function from only the first sound waves directly reaching said acousto-electric conversion means;

removing the dummy head or human from the listener position and the environment;

performing a second measuring in the environment, including picking up second sound waves emitted at the perceived sound source position with said acousto-electric conversion means in a state where the dummy head or human has been removed from the listener position and the environment while the remaining environment is the same as that of the first measuring, and measuring a natural-state transfer property from only the second sound waves directly reaching said acousto-electric conversion means;

normalizing said head-related transfer function measured by said first measuring with said natural-state transfer property measured by said second measuring to obtain a normalized head-related transfer function; and storing the normalized head-related transfer function obtained in said normalizing in a storage unit.

2. The head-related transfer function measurement method according to claim 1, wherein in said normalizing, an amount of data equivalent to a time from said first or second sound waves emitted at said perceived sound source position to directly reach said acousto-electric conversion means is eliminated from said head-related transfer function and said natural-state transfer property obtained in said first measuring and said second measuring, and said normalization processing is performed.

3. The head-related transfer function measurement method according to claim 1, said normalizing further comprising the steps of:

performing orthogonal transform on each of time-axial data directly reaching said acousto-electric conversion means, to transform into frequency-axial data of an X-Y coordinate system;

converting each of said frequency-axial data of the X-Y coordinate system into polar coordinate system data;

performing said normalization processing in the state of said polar coordinate system data to obtain data of said normalized head-related transfer function, and return the polar coordinate system data of this normalized head-related transfer function back to said X-Y coordinate data; and performing inverse orthogonal transform of said normalized head-related transfer function returned back to said X-Y coordinate system, to transform into time-axial data.

4. The head-related transfer function measurement method according to claim 3, wherein said orthogonal transform is complex FFT (Fast Fourier Transform) processing, and said inverse orthogonal transform is complex inverse FFT processing.

5. The head-related transfer function measurement method according to claim 3, further comprising a step of simplifying, for reducing the data length of time-axial data obtained by said inverse orthogonal transform.

6. A head-related transfer function measurement method comprising steps of:

performing a first measuring in an environment, including placing acousto-electric conversion means nearby both ears of a listener where placement of electro-acoustic conversion means is assumed, said acousto-electric conversion means being capable of picking up sound waves, picking up first sound waves emitted at a perceived sound source position with said acousto-electric conversion means in a state where a dummy head or a human exists at a listener position, and measuring a head-related transfer function from only the first sound waves directly reaching said acousto-electric conversion means;

removing the dummy head or human from the listener position and the environment;

performing a second measuring in the environment, including picking up second sound waves emitted at the perceived sound source position with said acousto-electric conversion means in a state where the dummy head or human has been removed from the listener position and the environment while the remaining environment is the same as that of the first measuring, and measuring a natural-state transfer property from only the second sound waves directly reaching said acousto-electric conversion means;

normalizing said head-related transfer function measured by said first measuring with said natural-state transfer property measured by said second measuring to obtain a normalized head-related transfer function;

storing the normalized head-related transfer function obtained in said normalizing in a storage unit; and convoluting, further including reading out the normalized head-related transfer function stored in the storage unit in said storing, and performing convolution on audio signals supplied to said electro-acoustic conversion means.

7. The head-related transfer function measurement method according to claim 6, wherein in said normalizing, an amount of data equivalent to a time from said first or second sound waves emitted at said perceived sound source position to directly reach said acousto-electric conversion means is eliminated from said head-related transfer function and said natural-state transfer property obtained in said first measuring and said second measuring, and said normalization processing is performed;

and wherein in said convoluting, audio signals to be supplied to said electro-acoustic conversion means are delayed by an amount of time corresponding to a distance between a perceived virtual sound image localization position and a position of said electro-acoustic conversion means, and the normalized head-related transfer function stored in the storage unit in said storing is convoluted in said delayed audio signals.

8. A head-related transfer function convolution device comprising:

a storage unit for storing normalized head-related transfer function data, the normalized head-related transfer function data having been obtained by placing acousto-electric conversion means nearby both ears of a listener where placement of electro-acoustic conversion means is assumed, said acousto-electric conversion means being capable of picking up sound waves, performing a first measuring in the environment, including picking up first sound waves emitted at a perceived sound source position with said acousto-electric conversion means in a state where a dummy head or a human exists at a listener position, and measuring a head-related transfer function from only the first sound waves directly reaching said acousto-electric conversion means, removing the dummy head or human from the listener position and the environment, performing a second measuring in the environment, including picking up second sound waves emitted at the perceived sound source position with said acousto-electric conversion means in a state where the dummy head or human has been removed from the listener position and the environment while the remaining environment is the same as that of the first measuring, and normalizing the head-related transfer function with a natural-state transfer property measured from only the second sound waves directly reaching said acousto-electric conversion means; and convolution means for performing convolution of the normalized head-related transfer function stored in the storage unit on audio signals supplied to said electro-acoustic conversion means.

9. The head-related transfer function convolution device according to claim 8, wherein an amount of data equivalent to time from said first or second sound waves emitted at said perceived sound source position to directly reach said acousto-electric conversion means is eliminated from said head-related transfer function and said natural-state transfer property obtained, and said normalization processing is performed;

and wherein at said convolution means, audio signals to be supplied to said electro-acoustic conversion means are delayed by an amount of time corresponding to a distance between a perceived virtual sound image localization position and a position of said electro-acoustic conversion means, and the normalized head-related transfer function stored in the storage unit is convoluted in said delayed audio signals.

10. A head-related transfer function measurement method comprising steps of:

performing a first measuring in an environment, including placing an acousto-electric conversion unit nearby both ears of a listener where placement of an electro-acoustic conversion unit is assumed, said acousto-electric conversion means being capable of picking up sound waves, picking up first sound waves emitted at a perceived sound source position with said acousto-electric conversion unit in a state where a dummy head or a human exists at a listener position, and measuring a head-related transfer function from only the first sound waves directly reaching said acousto-electric conversion unit;

removing the dummy head or human from the listener position and the environment:

performing a second measuring in the environment, including picking up second sound waves emitted at the perceived sound source position with said acousto-electric conversion unit in a state where the dummy head or human has been removed from the listener position and the environment while the remaining environment is the same as that of the first measuring, and measuring a natural-state transfer property from only the second sound waves directly reaching said acousto-electric conversion unit;

normalizing said head-related transfer function measured by said first measuring with said natural-state transfer property measured by said second measuring to obtain a normalized head-related transfer function; and storing the normalized head-related transfer function obtained in said normalizing in a storage unit.

11. A head-related transfer function measurement method comprising steps of:

performing a first measuring in an environment, including placing an acousto-electric conversion unit nearby both ears of a listener where placement of an electro-acoustic conversion unit is assumed, said acousto-electric conversion means being capable of picking up sound waves, picking up first sound waves emitted at a perceived sound source position with said acousto-electric conversion unit in a state where a dummy head or a human exists at a listener position, and measuring a head-related transfer function from only the first sound waves directly reaching said acousto-electric conversion unit;

removing the dummy head or human from the listener position and the environment;

performing a second measuring in the environment, including picking up second sound waves emitted at the perceived sound source position with said acousto-electric conversion unit in a state where the dummy head or human has been removed from the listener position and the environment while the remaining environment is the same as that of the first measuring, and measuring a natural-state transfer property from only the second sound waves directly reaching said acousto-electric conversion unit;

normalizing said head-related transfer function measured by said first measuring with said natural-state transfer property measured by said second measuring to obtain a normalized head-related transfer function;

storing the normalized head-related transfer function obtained in said normalizing in a storage unit; and convoluting, further including reading out the normalized head-related transfer function stored in the storage unit in said storing, and performing convolution on audio signals supplied to said electro-acoustic conversion unit.

12. A head-related transfer function convolution device comprising:

a storage unit for storing normalized head-related transfer function data, the normalized head-related transfer function data having been obtained by placing an acousto-electric conversion unit nearby both ears of a listener where placement of an electro-acoustic conversion unit is assumed, said acousto-electric conversion means being capable of picking up sound waves, performing a first measuring in the environment, including picking up first sound waves emitted at a perceived sound source position with said acousto-electric conversion unit in a state where a dummy head or a human exists at a listener position, measuring a head-related transfer function from only the first sound waves directly reaching said acousto-electric conversion unit, removing the dummy head or human from the listener position and the environment, performing a second measuring in the environment. including picking up second sound waves emitted at the perceived sound source position with said acousto-electric conversion unit in a state where the dummy head or human has been removed from the listener position and the environment while the remaining environment is the same as that of the first measuring, and normalizing the head-related transfer function with a natural-state transfer property measured from only the second sound waves directly reaching said acousto-electric conversion unit; and a convolution unit for performing convolution of the normalized head-related transfer function stored in the storage unit on audio signals supplied to said electro-acoustic conversion unit.

* * * * *